US005967509A

United States Patent [19]

Rasimus et al.

[11] Patent Number: 5,967,509

[45] Date of Patent: Oct. 19, 1999

[54] APPARATUS FOR PICKING ROLL HEADERS

[75] Inventors: Seppo Rasimus; Ismo Itkonen, both of Savonlinna, Finland

[73] Assignee: Saimatec Engineering OY, Savonlinna, Finland

[21] Appl. No.: 08/847,607

[22] Filed: Apr. 25, 1997

[30] Foreign Application Priority Data

May 2, 1996 [FI] Finland ..... 961868

[51] Int. Cl.[6] ..... B65H 3/54

[52] U.S. Cl. ..... 271/167; 271/104

[58] Field of Search ..... 221/251, 267; 271/104, 167; 414/796.9, 797, 797.1

[56] References Cited

U.S. PATENT DOCUMENTS

| | | | |
|---|---|---|---|
| 3,627,308 | 12/1971 | Stoever | 271/26 |
| 3,822,024 | 7/1974 | Endter et al. | 414/797 X |
| 4,234,101 | 11/1980 | Pastore | 221/267 X |
| 4,327,843 | 5/1982 | Corley | 221/267 X |
| 5,171,007 | 12/1992 | Kasprzak et al. | 271/104 |
| 5,433,426 | 7/1995 | Bond | 271/104 X |

FOREIGN PATENT DOCUMENTS

| | | | |
|---|---|---|---|
| 762898 | 10/1976 | Finland . | |
| 84045 | 10/1990 | Finland . | |
| 25 06 397 A1 | 8/1975 | Germany . | |
| 38 14 075 A1 | 11/1989 | Germany . | |
| 976689 | 12/1964 | United Kingdom | 414/797 |
| WO 88/01598 | 3/1988 | WIPO . | |

*Primary Examiner*—Janice L. Krizek
*Attorney, Agent, or Firm*—Kubovcik & Kubovcik

[57] ABSTRACT

An apparatus for picking roll headers (2) separately one-by-one from a stack (1). The apparatus includes a picking device (3), which is adapted for picking always the uppermost header (2) from the stack (1). The invention is implemented by providing the apparatus with at least one clamp member (6) arranged to extend at least partially above the header stack (1) simultaneously being supported against the upper rim edge of the header stack (1), whereby the clamp member(s) (6) is/are able to keep the next header below stationary during the picking of the uppermost header.

4 Claims, 2 Drawing Sheets

APPARATUS FOR PICKING ROLL HEADERS

Figure 1:
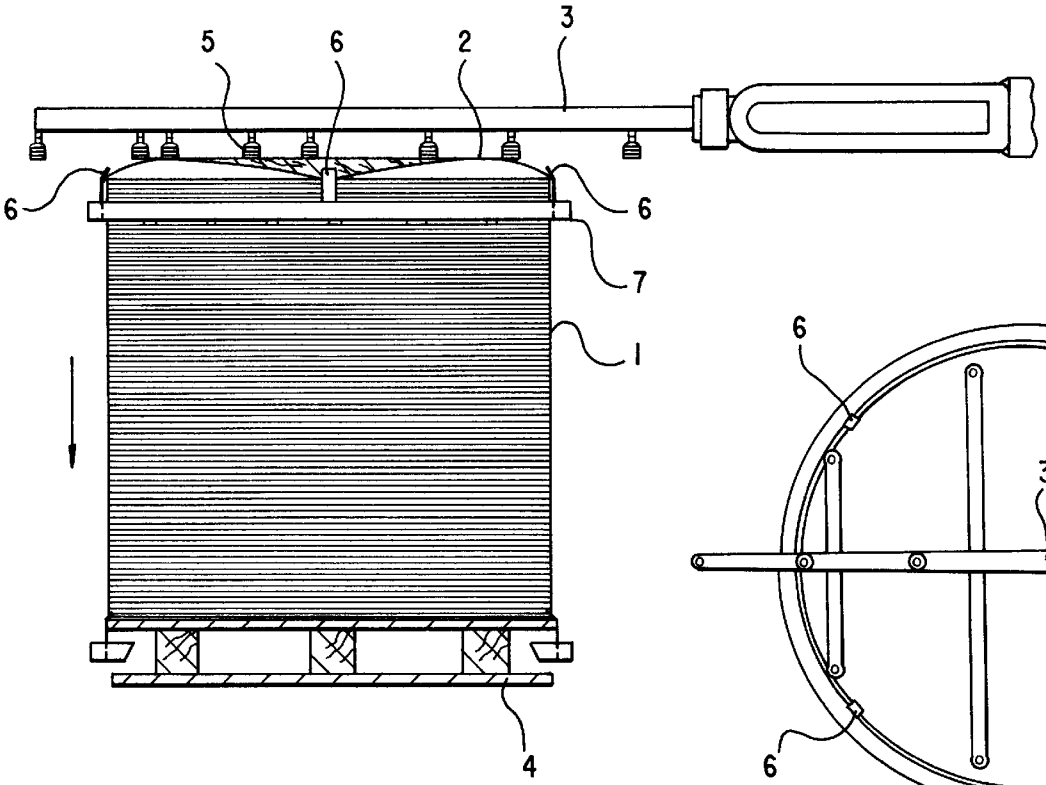

The present invention relates to an apparatus for picking roll headers separately one-by-one from a stack, said apparatus including a picking device, which is adapted for picking always the uppermost header from the stack, and clamp members, which are arranged to extend at Least partially above said header stack simultaneously being supported against the upper rim edge of the stack, whereby said clamp members serve to keep the next header below stationary during the picking of the uppermost header.

Such an apparatus is used particularly in conjunction with the wrapping of paper rolls during the picking of headers 15 from a header stack for the attachment of the headers to the roll ends.

In the grabbing of flexible and porous headers, e.g., those made from paper or paperboard material which are typically stored in stacks, a problem arises when a controlled picking of each header separately from the stack is desired, that is, picking the uppermost header without also inadvertently grabbing simultaneuosly the next header(s) below from the stack. The problem is worse the higher the header stack, since the substantial weight of the header stack tends to cause "glueing" of superimposed headers to each other.

A great number of conventional picking apparatuses are based on direct planar suction cup grabbing without any special header separating action. Particularly in conjunction with porous materials, the picking step easily tends to lift more than one header at a time. For the purpose of detaching the extra headers, an arrangement has been developed in which brushes have been placed about the rim of the header stack that prevent more than one header from becoming lifted up. This embodiment has an unreliable function and its construction limits the maximum practical height of the header stack to as small as about 300 mm.

FI Pat. Appl. No. 884,948 discloses a method and grabber based on the concept that the header stack is pressed downward from its center area and simultaneously the radially inward movement of the grabber elements, which is directed toward the center area of the header, is utilized for flexing the uppermost header partially apart from the underlying header(s). Here, the separate detachment of the uppermost header during the upward movement of the grabber elements is assured by depressing the header stack downward at its center. In the case of stiffer header material, such as paperboard, the radially inward movement of the grabber elements toward the header center area can be combined with the simultaneous upward movement of the grabber elements. In this arrangement, the grabber elements are not actively transferred radially toward the header center area, but instead, such a movement is passively caused by the flexing of the header under the upward movement of the grabber device. While such an embodiment possesses certain benefits, it has an extremely complicated structure and, resultingly, high weight. The latter is a particularly serious disadvantage when the picking action is implemented using industrial robots that have a limited payload capacity. Then, it is impossible or at least most cumbersome for various reasons to use such heavy picking devices.

Furthermore, the operation of conventional header picking systems has not been sufficiently secure under all conditions, because they have no clamping action whatsoever for the underlying header during the upward/sideways lifting step of the uppermost header, whereby the air streams induced by the operation of the system easily tend to eject the underlying header aside. The larger the headers being handled and the faster the operation of the picking system the greater the problems occurring in conventional systems and apparatuses.

It is an object of the present invention to provide a novel type of header picking apparatus that is free from the above-described problems. The apparatus according to the invention is characterized in that a number of header clamp members are placed essentially equidistantly spaced from each other about the perimeter of the header stack and that the header clamp members are connected to each other by means of a closed or open ring structure encircling the header stack.

Advantages of the invention include a simple structure and reliable function. The picking device itself can be of a conventional type. In addition to the picking device, the picking system needs only a simple accessory that secures one-by-one picking of the headers. The accessory disclosed herein has no moving parts or an external power supply nor any similar elements. An additional benefit of the present invention is therein that the header stack need not be absolutely vertical nor its top surface absolutely level.

Figure 2:
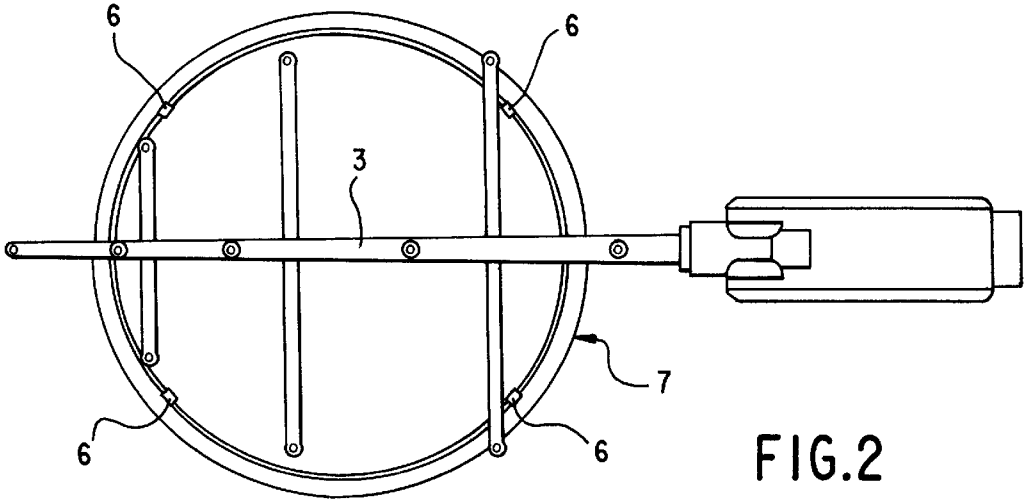
Figure 3:
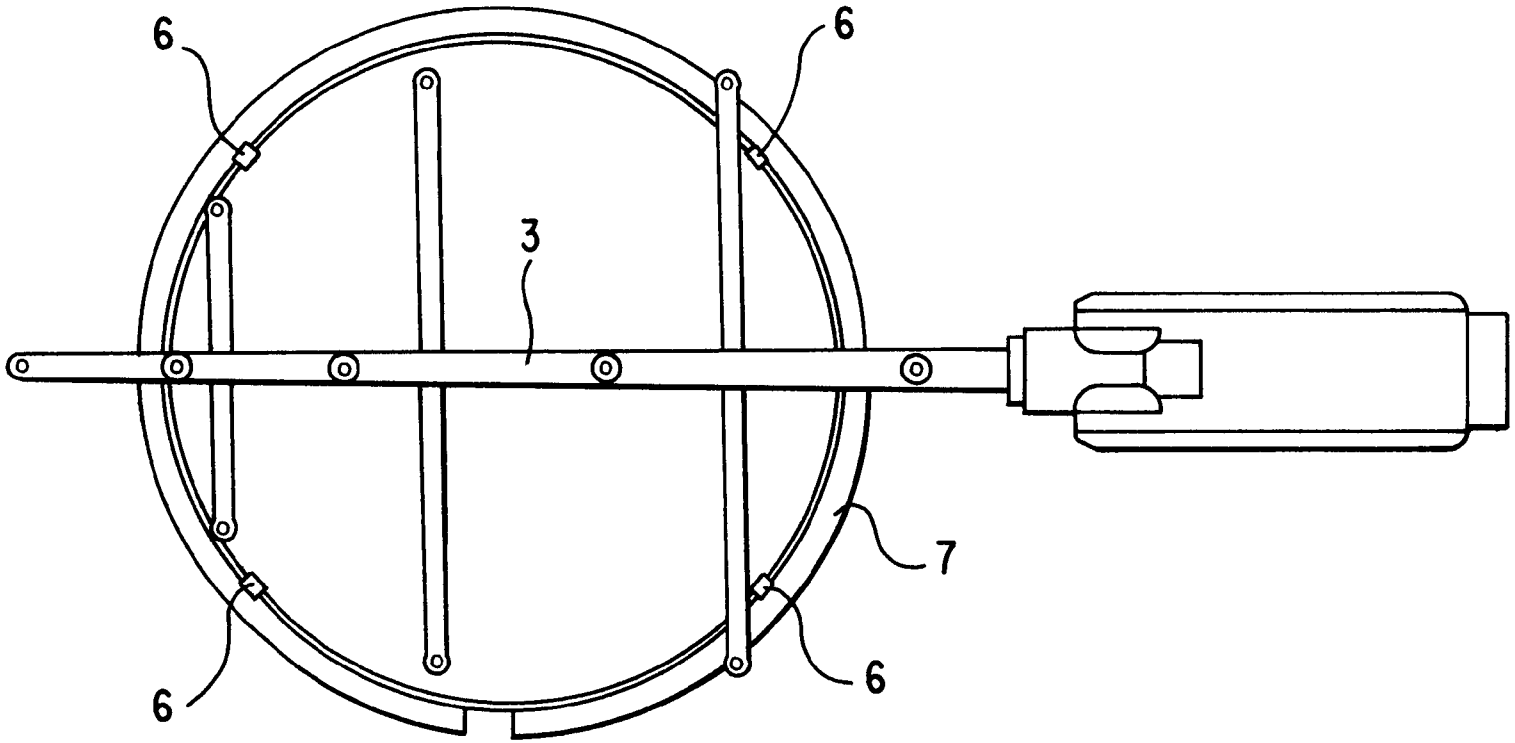

In the following, the invention will be described in greater detail with reference to the annexed drawings in which FIG. 1 is a side view of a header stack having a picking system according to the invention placed thereabout; and FIG. 2 is a top view of the same header stack.

Referring to FIG. 1, a header stack shown therein is denoted by reference numeral 1. Headers are conventionally circular, planar, flexible sheets cut from paper or paperboard web. While the conventional shape of headers is round, this need not necessarily be true. As described above, headers are used in the wrapping of a paper roll at both ends of the roll to seal the wrapper. In the illustration, the header stack 1 is shown placed in a conventional manner onto a support 4.

Above the header stack 1 is located a header picking apparatus 3 implemented using, e.g., conventional suction cup or vacuum techniques. In fact, the header picking apparatus 3 can be of any type generally used in the art. In FIG. 1, the suction cups 5 of the header picking apparatus 3 are shown grabbing the uppermost header 2, lifting the header slightly upward.

The invention proper is related to the apparatus denoted by reference numerals 6 and 7. The apparatus shown therein comprises at least one, advantageously four clamp members 6 arranged to extend at least partially above the top level of the header stack 1 and to rest against the upper rim edge of the stack 1, whereby the clamp member or members 6 serve to keep the underlying header(s) stationary while the uppermost header is being picked. In practice, the upper end of the clamp members 6 is advantageously adapted to extend higher than the level of the uppermost header in the stack. Radially, the clamp members 6 are placed essentially equidistantly spaced from each other about the rim of the header stack. The clamp members 6 are advantageously connected to each other by means of a closed or open ring structure 7 encircling the header stack. In principle, the ring structure 7 itself could also be designed to act as the header stack clamp member assembly. Advantageously, the assembly of the clamp members 6 is comprised of divided or finger-like, upward-elongated members that are slightly inward bent so as to rest against the upper rim edge of the header stack 1. The assembly formed by the ring structure 7 and the clamp members 6 is gravity-hung by the tips of the clamp members 6 resting against the header stack upper rim edge. Thus, the assembly will automatically be lowered as the headers are picked off from the stack.

Advantageously, the overall height of the assembly formed by the ring structure 7 and the clamp members 6 is equal or slightly smaller than the height of the support 4 under the header stack 1, whereby the headers can be picked to the last one on the bottom of the stack without impairing the clamping function. In FIG. 1 is also shown a sectional view of the assembly 6, 7 in its approximately lowermost position into which it has sunken in the fashion indicated by the arrow at the left side of the header stack after almost all headers have been picked.

Advantageously, the ring structure 7 joining the clamp members 6 is additionally supported to the side of the header stack 1 in order to prevent the assembly from tilting due to, e.g., asymmetric load distribution or asymmetrically performed picking function.

To a person versed in the art, it is obvious that the invention is not limited by the above-described exemplifying embodiments, but rather may be varied within the scope and spirit of the annexed claims. Hence, it is obvious that the number, construction or shape of the clamp members can be subject to variation without any limitation. The clamp members 6 of the assembly are placed so that they do not cause disturbance to the function of, e.g. a suction cup grabber.

We claim:

1. An apparatus for picking roll headers (2) separately one-by-one from a stack (1), said apparatus comprising a picking device (3), which is adapted for picking always the uppermost header (2) from the stack (1), and an assembly (6, 7) including a plurality of clamp members (6), the plurality of clamp members (6) being arranged to extend at least partially above said header stack (1) while simultaneously being supported against an upper rim edge of the stack (1), said assembly (6, 7) serving to keep the next header below stationary during picking of the uppermost header by the picking device (3), wherein said assembly (6, 7) is gravity-hung by tips of the clamp members resting against an upper rim edge of the header stack (1) and wherein said assembly (6, 7) comprises a ring (7) encircling the header stack and the plurality of the clamp members (6) are spaced about the ring (7).

2. An apparatus as defined in claim 1 characterized in that the overall height of the assembly formed by the clamp members (6) is equal or slightly smaller than the height of a support (4) under the header stack (1), whereby the headers can be picked to the last one on the bottom of the stack (1) without impairing the clamping function.

3. An apparatus as defined in claim 1, wherein the clamp members (6) are spaced essentially equidistantly from each other.

4. An apparatus as defined in claim 2, wherein the clamp members (6) are spaced essentially equidistantly from each other.

* * * * *